US008441203B1

(12) United States Patent
Xiong

(10) Patent No.: US 8,441,203 B1
(45) Date of Patent: May 14, 2013

(54) DIMMING ELECTRONIC BALLAST FOR TRUE PARALLEL LAMP OPERATION

(75) Inventor: Wei Xiong, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 411 days.

(21) Appl. No.: 12/817,739

(22) Filed: Jun. 17, 2010

(51) Int. Cl.
*H05B 37/02* (2006.01)

(52) U.S. Cl.
USPC ..... 315/291; 315/224; 315/307; 315/DIG. 7

(58) Field of Classification Search ..... 315/291, 315/307, 308, 224, 209 R, DIG. 2, DIG. 5, 315/DIG. 7
See application file for complete search history.

(56) References Cited

U.S. PATENT DOCUMENTS 5,519,289 A 5/1996 Katyl et al.
5,563,473 A 10/1996 Mattas et al.
5,877,592 A 3/1999 Hesterman et al.
5,982,109 A 11/1999 Konopka et al.
6,320,329 B1 11/2001 Wacyk
6,667,584 B2 12/2003 Hooijer et al.
6,864,645 B2 * 3/2005 Sun et al. ..... 315/308
7,193,368 B2 3/2007 Chen et al.
7,755,296 B2 * 7/2010 Yang et al. ..... 315/219
2006/0244395 A1 11/2006 Taipale et al.

* cited by examiner

*Primary Examiner* — David H Vu
(74) *Attorney, Agent, or Firm* — Waddey & Patterson, P.C.; Mark J. Patterson; Gary L. Montle

(57) ABSTRACT

A dimmable and program start electronic ballast is configured for powering one or more lamps in a true parallel configuration. An inverter driver is coupled to each gate of a pair of inverter switches and is responsive to at least a reference input signal and a feedback input signal to drive the inverter switches. The inverter circuit is effective thereby to generate an output voltage at an inverter output terminal between the pair of switches. One or more tank circuits are coupled in parallel, with a first end of each coupled to the inverter output terminal. Each tank circuit has a switching circuit as well as first and second output terminals on a second end which can receive a discharge lamp filament. A controller is configured to adjust a switching state for each of the one or more switching circuits and thereby enable or disable an associated tank circuit.

13 Claims, 4 Drawing Sheets

DIMMING ELECTRONIC BALLAST FOR TRUE PARALLEL LAMP OPERATION

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: N/A

BACKGROUND OF THE INVENTION

The present invention relates generally to electronic ballasts for powering discharge lamps. More particularly, the present invention relates to electronic ballasts capable of powering one or more lamps independently in both a full illumination (brightness) mode and a dimmed illumination mode that is less than the full illumination mode. Even more particularly, the present invention relates to dimmable electronic ballasts capable of powering multiple lamps independently in a true parallel configuration and providing appropriate lamp filament heating to ensure stable and reliable operation of the lamps in the dimmed mode.

Dimmable electronic ballasts have become increasingly popular because of their light output control and energy saving features. However, conventional dimming ballasts are typically not configured to power multiple discharge lamps independently. Instead, most existing dimmable electronic ballasts are configured for powering lamps connected in series, which means that if any one lamp is removed from the circuit all of the lamps will be shut down.

Further, in such an arrangement if any one lamp reaches an end-of-life condition the ballast itself will very likely be permanently disabled. This necessarily requires lamp replacement after the failure of any one lamp in the serial connection, which can be a significant expense, particularly when repeated over a period of time.

Another drawback for traditional so-called parallel lamp ballasts, typically having a current-fed parallel resonant topology, is that whenever a single lamp is taken out of the circuit the lamp current through the remaining lamps in the circuit may change dramatically. A true parallel lamp configuration should maintain the same lamp current output regardless of the number of lamps coupled to the electronic ballast.

BRIEF SUMMARY OF THE INVENTION

An electronic ballast is provided in accordance with the present invention which is capable of powering multiple discharge lamps in a true parallel configuration. In one aspect, an electronic ballast of the present invention may further independently provide dimmable operation for one or more discharge lamps.

In another aspect, an electronic ballast in accordance with the present invention may maintain constant lamp current output regardless of the number of discharge lamps coupled to the ballast.

In yet another aspect, an electronic ballast in accordance with the present invention may have a structure configurable for selectably powering one or more portions of the true parallel lamp configuration.

Briefly stated, in one embodiment a dimmable and program start electronic ballast is configured for powering one or more lamps in a true parallel configuration. An inverter driver is coupled to each gate of a pair of inverter switches and is responsive to at least a reference input signal and a feedback input signal to drive the inverter switches. The inverter circuit is effective thereby to generate an output voltage at an inverter output terminal between the pair of switches. One or more tank circuits are coupled in parallel, with a first end of each coupled to the inverter output terminal. Each tank circuit has a switching circuit as well as first and second output terminals on a second end which can receive a discharge lamp filament. A controller is configured to adjust a switching state for each of the one or more switching circuits and thereby enable or disable an associated tank circuit.

In another embodiment an electronic ballast is provided with an inverter and a plurality of inverter output branches coupled in parallel on their first ends to an inverter output terminal. A second end of each branch is configured to receive a first end of an associated lamp and supply power from the inverter output terminal to the lamp. A lamp current sensor is configured to sense a current through each lamp coupled to the plurality of branches. A controller is responsive to one or more feedback signals from the branches to enable and disable power supply to the associated lamps and to adjust a reference voltage to the inverter. The inverter is further responsive to the reference voltage and an output from the lamp current sensor to adjust the inverter output to the plurality of branches.

In another embodiment, a method is provided for operating one or more discharge lamps in a true parallel configuration. A first step of the method includes providing a plurality of tank circuits coupled on their first ends to an inverter output terminal, with each tank circuit configured on their second ends to receive a discharge lamp filament, and each tank circuit further including a switching circuit between the first end and the second end. A second step includes detecting a lamp filament status for each of the tank circuits. A switch state for each switch circuit is controlled to enable or disable the associated tank circuit based upon the detected lamp filament status. An inverter power output is further adjusted based upon the detected lamp filament status. Another step includes detecting an overvoltage status for each of the tank circuits. The inverter is controlled to enable or disable the inverter based upon the detected overvoltage status. A switch state for each switch circuit is further controlled to enable or disable the associated tank circuit based upon the detected overvoltage status. An inverter power output is even further adjusted based upon the detected overvoltage status.

DETAILED DESCRIPTION OF THE INVENTION

Figure 1:
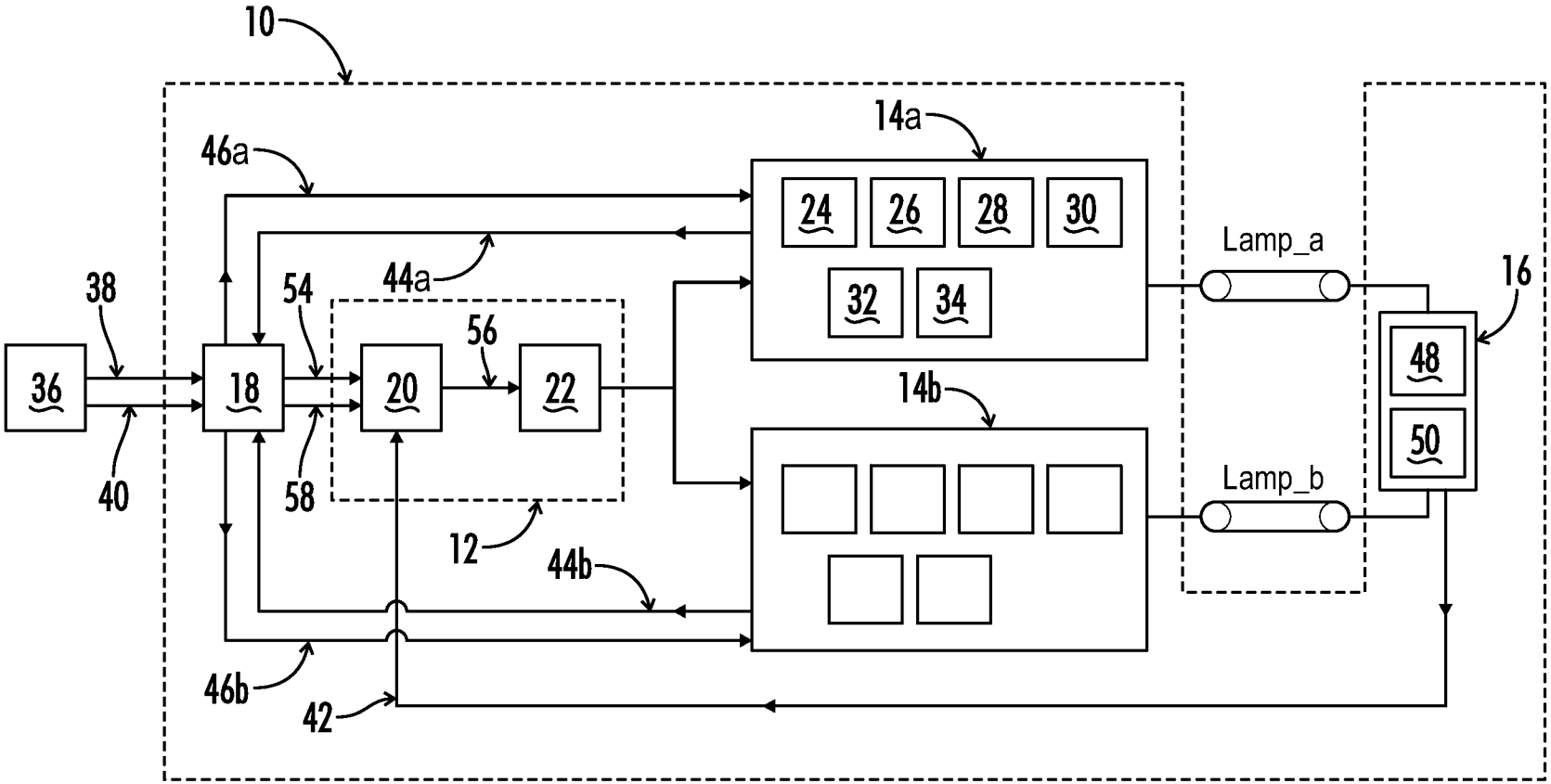
FIG. 1 is a block diagram showing an embodiment of an electronic ballast in accordance with the present invention.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct electrical connection between the connected items or an indirect connection through one or more passive or active intermediary devices.

The term "circuit" means at least either a single component or a multiplicity of components, either active and/or passive, that are coupled together to provide a desired function.

The term "signal" means at least one current, voltage, charge, temperature, data or other signal.

The terms "switching element" and "switch" may be used interchangeably and may refer herein to at least: a variety of transistors as known in the art (including but not limited to FET, BJT, IGBT, IGFET, etc.), a switching diode, a silicon controlled rectifier (SCR), a diode for alternating current (DIAC), a triode for alternating current (TRIAC), a mechanical single pole/double pole switch (SPDT), or electrical, solid state or reed relays. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa.

The terms "power converter" and "converter" unless otherwise defined with respect to a particular element may be used interchangeably herein and with reference to at least DC-DC, DC-AC, AC-DC, buck, buck-boost, boost, half-bridge, full-bridge, H-bridge or various other forms of power conversion or inversion as known to one of skill in the art.

The term "controller" as used herein may refer to at least a general microprocessor, an application specific integrated circuit (ASIC), a digital signal processor (DSP), a microcontroller, a field programmable gate array, or various alternative blocks of discrete circuitry as known in the art, designed to perform functions as further defined herein.

Referring generally to FIGS. 1-4, various embodiments of an electronic ballast 10 for powering one or more discharge lamps in a true parallel configuration may be herein described. Where the various figures may describe embodiments sharing various common elements and features with other embodiments, similar elements and features are given the same reference numerals and redundant description thereof may be omitted below. Further, where equivalent components (reference numeral)(a, b . . . x) of various circuits such as the tank circuitry described below have substantially identical functionality they may be defined collectively by their common reference numeral.

Referring first to FIG. 1, in one embodiment the ballast 10 includes an inverter circuit 12 and a plurality of tank circuits 14*a*, 14*b* or branches 14*a*, 14*b*, each of which are configured to receive and supply power from the inverter circuit 12 to a first end of an associated discharge lamp Lamp_a, Lamp_b. In the embodiment shown, two branches 14*a*, 14*b* are coupled in parallel with each other but in various alternative embodiments any two or more branches 14*a* . . . 14*x* may be anticipated within the scope of the present invention. The ballast 10 of FIG. 1 further includes a load circuit 16 or secondary circuit 16 which is further configured to receive a second end of each lamp that may be coupled to the plurality of tank circuits 14.

Figure 2:
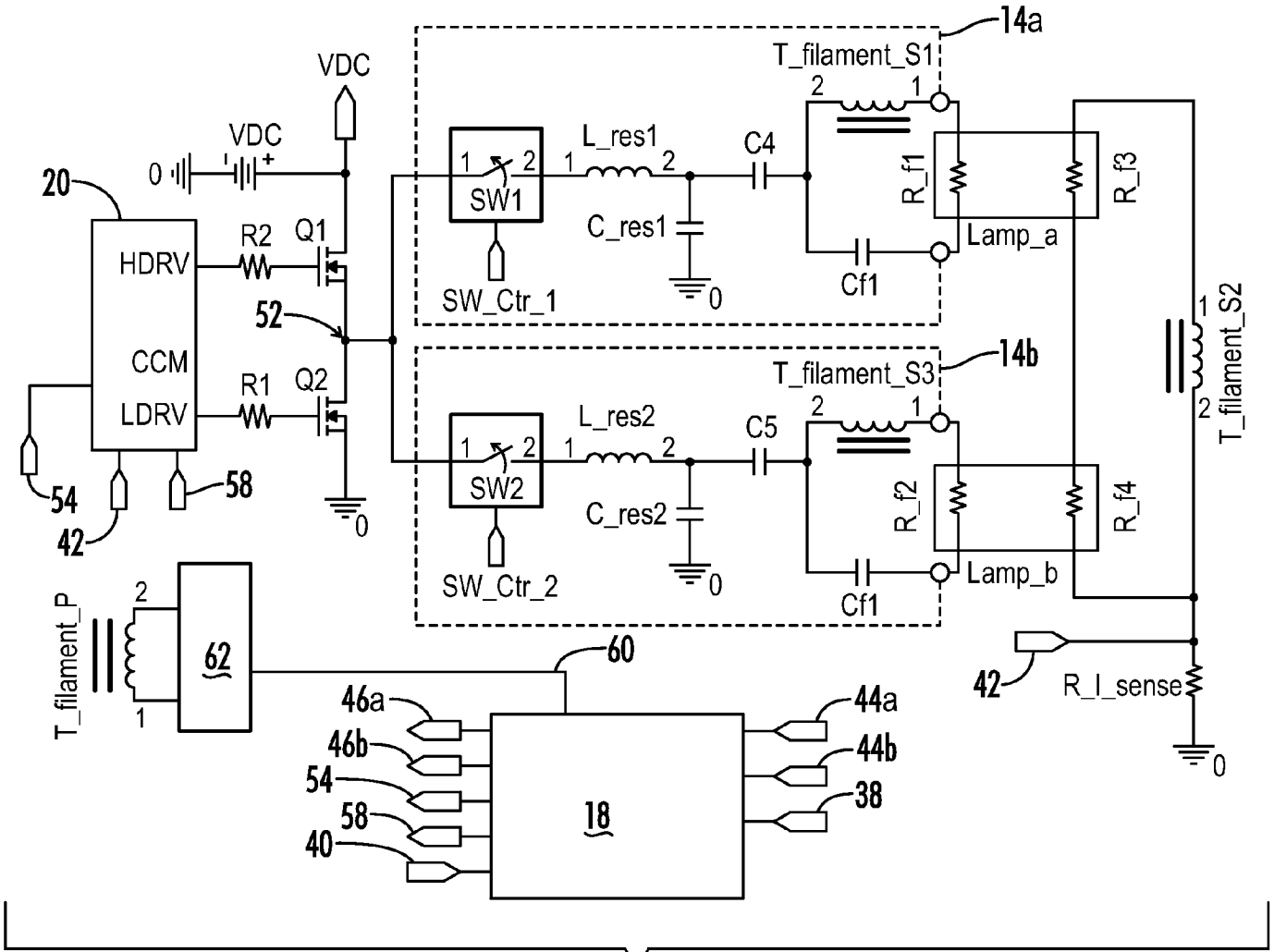
FIG. 2 is a circuit diagram showing another embodiment of an electronic ballast in accordance with the present invention.

The inverter circuit 12 in various embodiments may further include an oscillation circuit 22 which is driven by an inverter driver 20. With reference to FIG. 2, in a typical embodiment the oscillation circuit 22 is formed of a pair of switching elements Q1, Q2 in a half-bridge configuration. A node 52 (FIG. 2) between the switching elements Q1, Q2 may further define an inverter output terminal 52 to which each of the plurality of branches 14 are coupled. Inverter drivers 20 are well known in the art and the present invention contemplates using one of these known inverter drivers to determine a driving frequency for the switching elements Q1, Q2 and to generate pulse outputs 56 to the switching elements Q1, Q2 to cause oscillation of the switching elements Q1, Q2 at the desired frequency. Accordingly, a DC input signal to the inverter circuit 12 is converted into an AC inverter output signal to the plurality of branches 14.

In various embodiments the driving frequency for the oscillation circuit 22 may be determined by the inverter driver 20 based on a reference input signal 54 and a lamp current feedback input signal 42. In an embodiment the load circuit 16 further includes a lamp current sensor 50, and the lamp current feedback input signal 42 may be provided from the lamp current sensor 50 to the inverter driver 20. The reference input signal 54 may be provided from a system controller 18, and may be predetermined or determinable by the system controller 18 based on various criteria as described further below.

Still referring to FIG. 1, in various embodiments each branch 14*a*, 14*b* may further be formed of a switching circuit block 24, a resonant circuit block 26, a filament sensor 28, a filament heating circuit 30, an overvoltage sensor 32 and an end-of-life (EOL) sensor 34. The filament sensor 28, overvoltage sensor 32 and EOL sensor 34 for each branch 14*a*, 14*b* may provide feedback signals (collectively denoted as 44*a*, 44*b*) to the controller 18. Each of the sensors 28, 32, 34 may be implemented in any number of various forms and structures as are well known in the art, and further description may thereby be omitted herein.

Based on the feedback signals 44 from the branches 14, the controller 18 provides a control signal 46 to the switching circuit block 24 for each branch 14 and further provides the reference input signal 54 and an inverter shutdown signal 58 (as needed) to the inverter driver 20. The switching circuit block 24 is effective to enable or disable the associated branch 14 based on the control signal 46 provided from the controller 18, and the inverter driver 20 is further effective to enable or disable the ballast 10 generally based on the inverter shutdown signal 58 provided from the controller 18.

In an embodiment as shown, the filament heating circuit 30 in each branch 14, in combination with a filament heating component 48 in the collective load circuit 16, preheats filaments for each lamp coupled to the ballast in response to a filament voltage control signal 60 provided from the controller 18 to a filament voltage control block 62 (as further shown in FIG. 2).

In various embodiments the controller 18 may provide the control signal 46 to the switching circuit block 24 for each branch 14, the reference input signal 54 and the inverter shutdown signal 58 to the inverter driver 20, and the filament voltage control signal 60 to the filament voltage control block 62. These signals may be based not only upon feedback signals 44 from the branches/tank circuits 14, but also upon external control signals 38, 40 from an external control interface 36. A first external control signal 38 may be a dimming control signal, and a second external control signal 40 may be a lamp shutdown signal, as further described below.

Referring to FIG. 2, the resonant circuit 26 of each branch 14*a*, 14*b* may typically include a resonant inductor L_res1, L_res2 and a resonant capacitor C_res1, C_res2. Lamp current limiting capacitors C4, C5 may further be coupled to the resonant components L_res, C_res. An output voltage from the filament voltage control block 62 may be provided across the primary side T_filament_P of a filament drive transformer, whose secondary windings are T_filament_s1, T_filament_s2, T_filament_s3. The filament heating circuit 30 of each branch 14*a*, 14*b* as shown in FIG. 1 may be formed of a secondary winding (T_filament_s1, T_filament_s2, respectively) of the filament drive transformer and coupled to filaments (R_f1, R_f2, respectively) on the first end of the associated lamp. The load circuit 16 may be formed of another secondary winding T_filament_s3 coupled to filaments (R_f3, R_f4, respectively) on the second ends of each lamp coupled to the ballast 10. Driving of the primary winding T_filament_P of the filament drive transformer by the filament voltage control block 62 thereby supports preheat (program start) functions and filament heating during dimming conditions.

In an embodiment as shown in FIG. 2, filament voltage control capacitors C_f1, C_f2 are coupled in parallel with the secondary windings T_filament_s1, T_filament_s2, respectively. The lamp current sensor 16 may be formed of resistor R_I_sense, where the lamp current feedback input signal 42 to the inverter driver 20 may be a detected current through the resistor R_I_sense as would be understood by one of skill in the art.

The switching circuit blocks 24 in each branch 14 in an embodiment as shown in FIG. 2 may include controllable switches SW1, SW2 controlled by signals SW_Ctr_1, SW_Ctr_2 from the controller 18.

Figure 3:
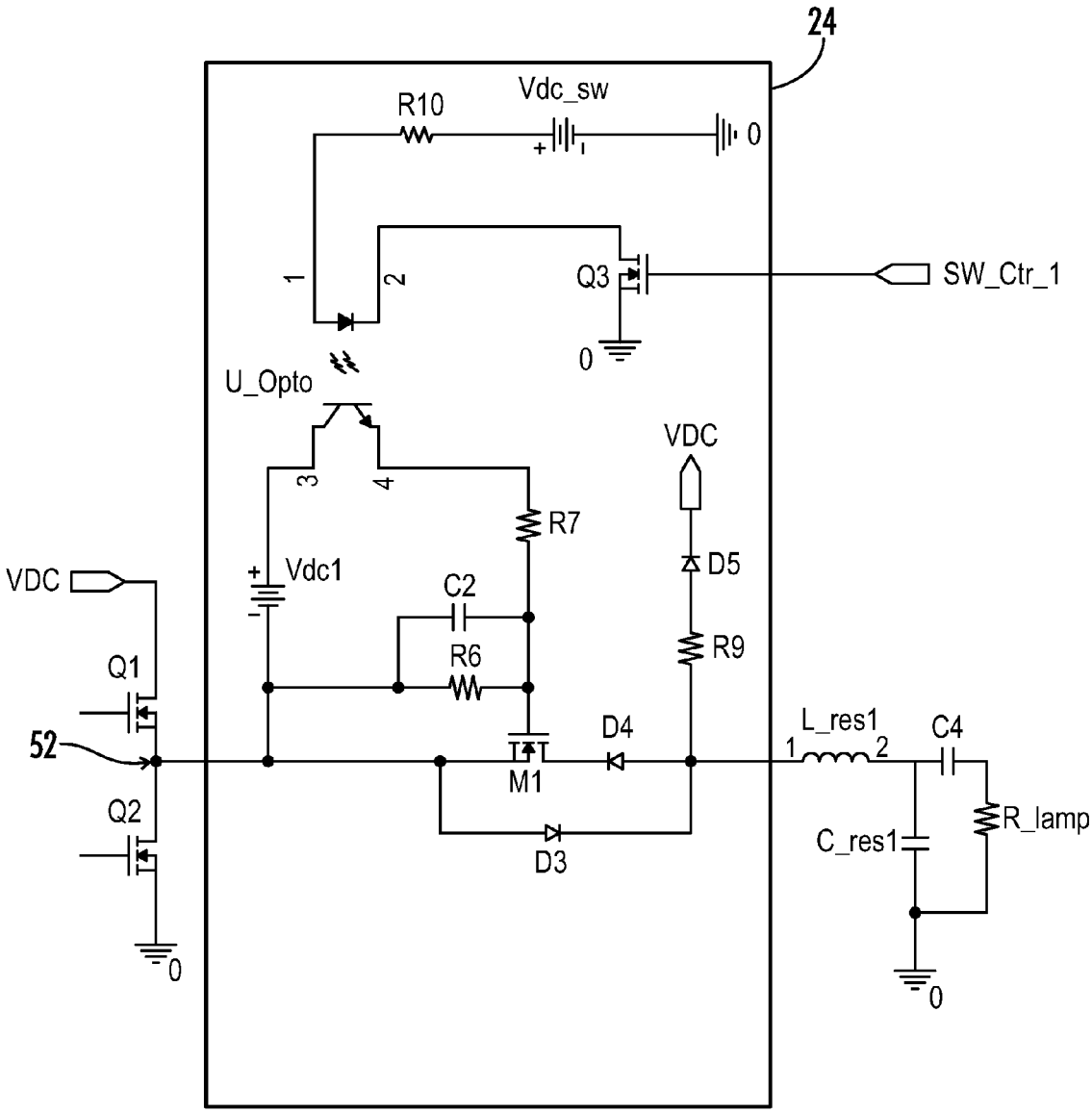
FIG. 3 is a circuit diagram showing an embodiment of a switch control block in the ballast as shown in FIG. 2.

Referring now to FIG. 3, an exemplary implementation of the switching control block 24 may be described further. Main voltage controlled switch M1 is connected with a diode D4 to assure unidirectional current flow into the switch M1. Diode D3 is connected in parallel with switch M1 and diode D4 to provide reverse direction current flow. Capacitor C2 and resistor R6 are connected in parallel to improve the noise immunity at the gate of switch M1. Resistor R7 is the gate drive resistor, and Vdc1 is an isolated DC power supply. Another switch Q3 is provided in series with the primary side of opto-coupled switch U_opto.

When the control signal SW_ctr_1 from the controller 18 is high, the switch Q3 will be turned on. Power supply Vdc_sw will conduct current through resistor R10, switch Q3 and the primary side of the opto-coupler U_opto. As a result the isolated power supply Vdc1 will charge up capacitor C2 through resistor R7 and the secondary side of opto-coupler U_opto and turn on switch M1. As soon as switch M1 is turned on, the switch M1 and diodes D3, D4 form a short circuit between the inverter output terminal 52 and the resonant inductor L_res_1. The resonant circuit 26 and thereby the tank circuit 14 generally may thereby be directly connected to the inverter circuit 12 and power thereby provided to drive the associated lamp.

When the control signal SW_ctr_1 from the controller 18 is low, the switch Q3 will be turned off and no current would flow through the diode in the opto-coupler U_opto. As a result the secondary side of the opto-coupler U_opto will be turned off and no current would flow through resistor R7. Capacitor C2 will be discharged quickly by resistor R6, and as a result switch M1 will be turned off. As soon as switch M1 turns off, current can then only flow through diode D3 to the resonant tank 26 (L_res1, C_res1) and quickly charge up the resonant capacitor C_res1 to VDC. When the voltage across the resonant capacitor C_res1 reaches VDC, the diode D3 stops conducting and the tank circuit 14 is disabled. Resistor R9 and diode D5 are used to clamp the voltage across switch M1 and to prevent an overvoltage across the switch M1.

Figure 4:
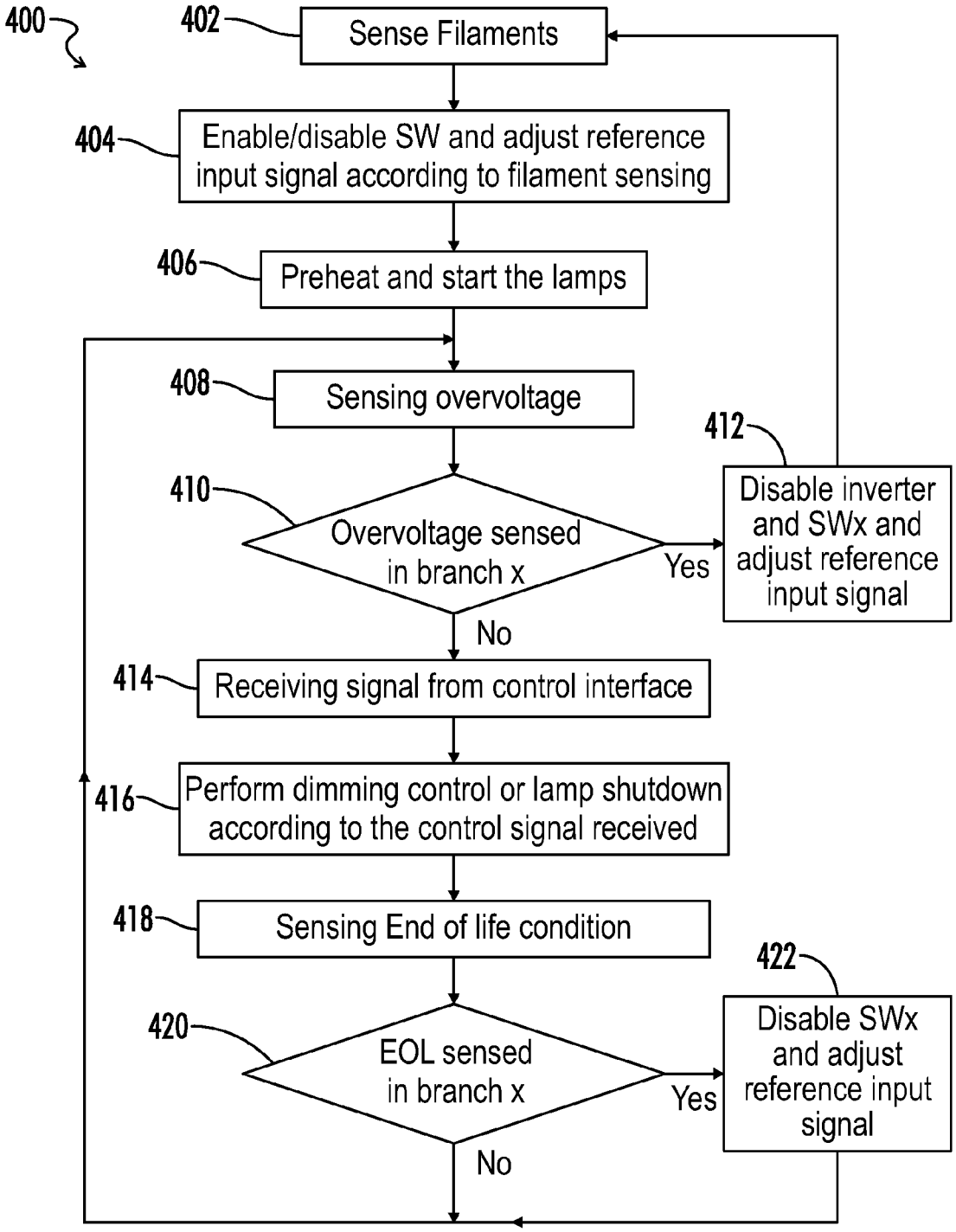
FIG. 4 is a flowchart showing an embodiment of a method of operation for the ballast of the present invention.

Referring to FIG. 4, an embodiment of a method of operation 400 may now be described with respect to electronic ballast configurations 10 as disclosed previously.

In a first step 402, the controller 18 at the beginning of a preheat stage for the ballast first detects the presence of any lamps that are coupled to the ballast by receiving lamp filament feedback signals from the lamp filament sensors 28. The filament sensors 28 of each branch 14 are designed to generate a missing lamp filament feedback signal when an associated lamp filament is removed or otherwise disconnected from the branch 14. In various embodiments the filament sensors 28 may provide a second signal indicative of a lamp filament being coupled to the branch 14, or alternatively the filament sensors 28 may only provide an output signal in response to a missing filament condition, with the controller 18 being effective to determine the number of lamps coupled to the ballast based on either form of filament status signal as may be understood by one of skill in the art.

If no lamp filament is detected by the controller 18 with respect to any one or more branches 14, the switching circuit blocks 24 for the one or more branches with missing lamp filaments are disabled, thereby disabling the associated branch 14 entirely (step 404). In various embodiments the controller 18 upon disabling any one or more branches 14 may further automatically adjust the reference signal input 54 to the inverter driver 20 such that the current through each remaining lamp may be maintained regardless of the number of lamps coupled to the ballast 10.

If no lamp filaments are detected by the controller 18 with respect to any of the branches 14, the controller 19 further provides an inverter shutdown signal to the inverter driver 20 and the inverter circuit 12 is thereby disabled until the controller 18 subsequently detects the presence of at least one lamp filament with respect to an associated branch 14. If lamp filaments are detected by the controller 18 with respect to each associated branch 14, the controller 18 takes no action, and the switching circuit blocks 24 and thereby the branches generally remain enabled.

After the number of lamp filaments presently coupled to the ballast has been determined, the method continues in step 406 by preheating and igniting the lamps. The controller 18 generates a control signal to the filament voltage control block 62 whereby filament drive transformer T_filament is driven to fully preheat the associated lamp filaments. When the filaments are properly heated, the controller 18 may enter an ignition (or a startup) stage wherein the driving frequency of the inverter switches Q1, Q2 is adjusted to generate a necessary lamp voltage for lamp ignition.

Continuing to step 408, after lamp ignition the overvoltage sensors 32 in each of the one or more enabled branches 14 may then detect any overvoltage condition which may be present. In various embodiments the overvoltage sensors 32 may provide first and second signals indicative of an overvoltage condition and the lack thereof, respectively, or alternatively the overvoltage sensors 32 may only provide an output signal when an overvoltage condition is present, with the controller 18 being effective to determine an overvoltage condition for the associated branch based on either form of overvoltage status signal as may be understood by one of skill in the art.

If the controller 18 determines in step 410 that an overvoltage condition is present for any one or more branches 14, the method 400 proceeds to step 412 where the controller 18 may provide commands to disable each of the inverter circuit 12 and the switching circuit blocks 24 associated with the one or more branches 14 having an overvoltage condition. The controller 18 subsequently may adjust the reference input voltage to the inverter driver 20 and enable or otherwise restart the inverter circuit 12 while maintaining a disabled state for the one or more branches 14 having the overvoltage condition. The method then returns to step 402 upon restart of the inverter circuit 12 such that the controller 18 may once again determine how many lamp filaments are present.

If the controller 18 determines in step 410 that no overvoltage condition is present, the method 400 proceeds to step 414 and the controller 18 receives any external control signals which may be provided from an external control interface.

In step 416, the controller 18 then carries out any control functions which may be required by the received external control signals. If the controller receives a dimming control signal, the controller 18 may respond by adjusting the reference input signal to the inverter driver (whereby the driving frequency of the inverter switches is adjusted to provide a lamp current corresponding to the desired dimming output) and by further adjusting the filament voltage control signal to the filament voltage control block (whereby an appropriate voltage is provided across the lamp filaments to maintain proper lamp operation at the desired dimming output).

Continuing to step 418, the end-of-life (EOL) sensors 34 in each of the one or more enabled branches 14 may then detect any EOL condition which may be present for an associated lamp. In various embodiments, the EOL sensors 34 may provide first and second signals indicative of an EOL condition and the lack thereof, respectively, or alternatively the EOL sensors 34 may only provide an output signal when an EOL condition is present, with the controller 18 being effective to determine an EOL condition for the associated branch based on either form of EOL status signal as may be understood by one of skill in the art.

If the controller 18 determines in step 420 that an EOL condition is present for any one or more branches 14, the method 400 proceeds to step 422 where the controller 18 may provide commands to disable the switching circuit blocks 24 associated with the one or more branches 14 having an EOL condition, and to adjust the reference input voltage to the inverter driver 20 to account for the one or more disabled branches. The method then returns to step 408 and continues steady state operation until such time as the ballast is shutdown manually or an overvoltage condition is detected.

If the controller 18 determines in step 420 that no overvoltage condition is present, the method 400 likewise returns to step 408 and continues steady state operation until such time as the ballast is shutdown manually or an overvoltage condition is detected.

The previous detailed description has been provided for the purposes of illustration and description. Thus, although there have been described particular embodiments of the present invention of a new and useful "Dimming Electronic Ballast for True Parallel Lamp Operation," it is not intended that such references be construed as limitations upon the scope of this invention except as set forth in the following claims.

What is claimed is:

1. An electronic ballast comprising:

an inverter circuit further comprising a pair of switches and an inverter driver coupled to each switch and responsive to at least a reference input signal and a feedback input signal to drive said switches, the inverter circuit effective thereby to generate an output voltage at an inverter output terminal between the pair of switches;

one or more tank circuits coupled in parallel, each tank circuit coupled on a first end to the inverter output terminal, each tank circuit further comprising first and second output terminals on a second end, the output terminals effective to receive a lamp filament connection at a first end of a discharge lamp, and one or more switching circuits; and a controller configured to adjust a switching state for each of said one or more switching circuits and thereby enable or disable an associated tank circuit.

2. The ballast of claim 1, each tank circuit further comprising a lamp filament sensor effective to provide an output signal indicating a missing lamp filament, and wherein the controller is responsive to a missing lamp filament output signal from a lamp filament sensor to disable a tank circuit associated with the lamp filament sensor providing said output signal.

3. The ballast of claim 2, wherein the controller is responsive to a missing lamp filament output signal from all of the one or more lamp filament sensors to disable the ballast.

4. The ballast of claim 3, further comprising a lamp current sensor effective to sense a current through one or more lamps coupled to the ballast and to provide the feedback input signal to the inverter driver, and wherein the controller is responsive to the lamp filament output signals from the lamp filament sensors to adjust the reference input signal to the inverter driver.

5. The ballast of claim 1, further comprising one or more overvoltage detection circuits effective to detect an overvoltage condition associated with any one or more tank circuits, and wherein the controller is responsive to an overvoltage signal provided by an overvoltage detection circuit to disable the inverter driver and the tank circuit associated with the overvoltage condition.

6. The ballast of claim 1, wherein the controller is further responsive to an overvoltage signal provided by an overvoltage detection circuit to restart the inverter driver and to maintain the tank circuit coupled to the lamp associated with the overvoltage condition in a disabled mode.

7. The ballast of claim 1, further comprising one or more end-of-life detection circuits effective to detect an end-of-life condition associated with any one or more lamps coupled to the ballast, and wherein the controller is responsive to an end-of-life signal provided by an end-of-life detection circuit to disable the tank circuit coupled to the lamp associated with the end-of-life condition.

8. The ballast of claim 7, further comprising a lamp current sensor effective to sense a current through one or more lamps coupled to the ballast and to provide the feedback input signal to the inverter driver, and wherein the controller is responsive to the lamp filament output signals from the lamp filament sensors to adjust the reference input signal to the inverter driver.

9. The ballast of claim 8, further comprising a filament heating transformer having a primary winding coupled to the controller and a plurality of secondary windings effective to provide filament heating to associated discharge lamp filaments.

10. The ballast of claim 9, the controller configured to receive a dimming control signal from an external control interface, and the controller responsive to said dimming control signal to adjust a filament heating voltage across the primary winding of the filament heating transformer and to further adjust the reference input signal to the inverter driver.

11. The ballast of claim 10, the controller further configured to receive an external ballast shutdown signal from said external control interface, and the controller responsive to said ballast shutdown signal to disable the inverter driver.

12. A method of operating one or more discharge lamps, the method comprising:

providing a plurality of tank circuits coupled on respective first ends to an inverter output terminal, each tank circuit configured on respective second ends to receive a discharge lamp filament, each tank circuit further comprising a switching circuit between the first end and the second end;

detecting a lamp filament status for each of the tank circuits, and controlling a switch state for each switch circuit to enable or disable the associated tank circuit based upon the detected lamp filament status;

adjusting an inverter power output based upon the detected lamp filament status;

detecting an overvoltage status for each of the tank circuits, controlling the inverter to enable or disable the inverter based upon the detected overvoltage status, and controlling a switch state for each switch circuit to enable or disable the associated tank circuit based upon the detected overvoltage status; and adjusting an inverter power output based upon the detected overvoltage status.

13. The method of claim 12, further comprising the steps of:

detecting an end-of-life status for each of the tank circuits;

controlling a switch state for each switch circuit to enable or disable the associated tank circuit based upon the detected lamp filament status; and adjusting an inverter power output based upon the detected lamp filament status.

* * * * *